United States Patent [19]

Brill

[11] Patent Number: 4,939,340

[45] Date of Patent: Jul. 3, 1990

[54] MOLDABLE CURLING IRON

[75] Inventor: Richard H. Brill, Philadelphia, Pa.

[73] Assignee: Conair Corporation, Stamford, Conn.

[21] Appl. No.: 317,528

[22] Filed: Mar. 1, 1989

[51] Int. Cl.[5] ..... A45D 1/04

[52] U.S. Cl. ..... 219/225; 132/229; 132/232

[58] Field of Search ..... 219/225, 226, 227, 228, 219/229; 132/227, 229, 232

[56] References Cited

U.S. PATENT DOCUMENTS

| | | | |
|---|---|---|---|
| 4,233,999 | 11/1980 | Thomas | 132/232 |
| 4,469,934 | 9/1984 | Isshiki et al. | 132/225 X |
| 4,477,716 | 10/1984 | Thaler et al. | 219/225 |
| 4,602,143 | 7/1986 | Mack et al. | 219/225 |
| 4,797,533 | 1/1989 | Santhouse et al. | 219/225 |

*Primary Examiner*—C. L. Albritton

*Attorney, Agent, or Firm*—Haynes N. Johnson

[57] ABSTRACT

A curling iron is provided which is easy to assemble and, so, more economical to manufacture. The unit is molded in two snap-together halves, one half being the bottom portion (divided axially) and the other half being the top portion, and a molded spoon. The molded sections would include all the parts except for the electrical components. The curling iron is assembled by inserting the electrical components in one half, snapping the two halves together, and then snapping the spoon into place over the upper half. The molded sections are formed of a high temperature thermoplastic material. This material is transparent to infra-red rays; and, so, if an infra-red heater is used, the rays can pass through the plastic and heat the hair directly.

16 Claims, 3 Drawing Sheets

MOLDABLE CURLING IRON

FIELD OF THE INVENTION

This invention relates to the field of curling irons and, in particular, to curling irons in which parts which are normally metallic, such as the barrel, are molded of thermoplastic material. Further, it relates to such units in which substantially the entire iron, except for electrical components is formed of two molded and halves which snap-fit together for easy assembly.

BACKGROUND OF THE INVENTION

In the past curling irons have been made of a multiplicity of separate parts, some plastic and some metallic, which are fitted together and then bonded either with screws or by ultrasonic welding. This assembly method was more time consuming than it now appears to be necessary.

BRIEF SUMMARY OF THE INVENTION

I have developed a curling iron that is easy to assemble and, so, more economical to manufacture. This is accomplished by molding the unit in two snap-together halves. Preferably, one half would be the bottom portion (divided axially) and the other would be the top portion. The molded sections would include all the parts except for the electrical components. The curling iron would be assembled by inserting the electrical components in one section, snapping the two sections together, and then snapping the spoon into place over the upper half.

The molded sections are formed of a high temperature plastic, such as a General Electric product called Ultem. This material is transparent to infra-red rays; and, so, if an infrared heater is used, the rays can pass through the plastic and heat the hair directly. Alternatively, conventional resistance wire heaters or rope heaters can be used.

DETAILED DESCRIPTION OF THE INVENTION

Figure 1:
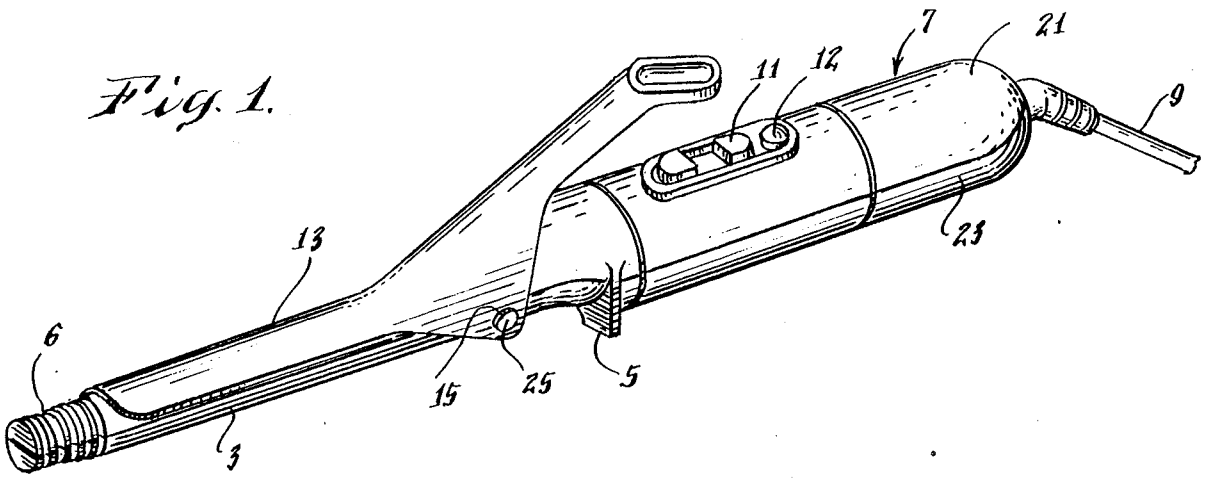
FIG. 1 is a perspective view of an assembled curling iron of the type which can be made using my invention.
Figure 2:
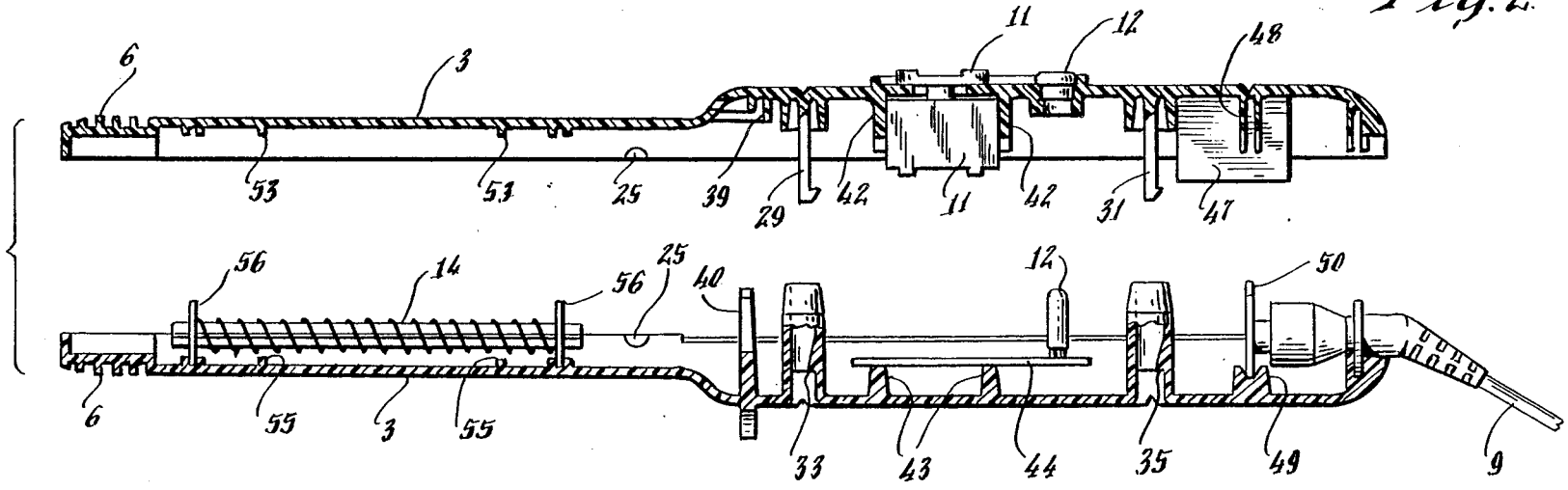
FIG. 2 is an exploded vertical section showing how the two molded halves fit together.

My curling iron 1 is shown in perspective in FIG. 1. It includes a barrel 3 with an integrally molded stand 5 and handle 7. It has the usual line cord 9, switch 11, and an "on" indicator light 12. A separately molded spoon 13 is pivotally mounted on pins 25 so that it fits over a portion of the upper surface of the barrel in the usual manner.

The entire iron, except for the electrical components, is molded in three pieces, the upper half or section 21, the lower half or section 23, and the spoon 13. Sections 21 and 23 run axially of the iron and are designed to complementarily interfit with one another. Spoon 13 has openings 15 on its sides so that it can snap over pins 25 (which are molded into lower section 23) for a pivotal fit. Spoon 13 is spring-pressed into position by spring 17.

Sections 21 and 23, and possibly spoon 13, are molded of a high temperature thermoplastic material which is transparent to infra-red rays. I prefer a polyetherimide copolymer resin having a softening point of about 219° C. and a deflection temperature at 264 p.s.i. of about 200° C. This plastic material could be, for example, that which is sold by General Electric Company as Ultem #1010.

Upper section 21 includes one-half of the barrel 3 and its tip 6 and one-half of the handle 7. Spoon 13 is mounted to press against its part of the barrel. Section 21 includes resilient latch members 29 and 31 extending inwardly from the inner surface of the handle for engagement with complementary catches 33 and 35 extending inwardly from the handle portion of the lower section 23.

Figures 3, 4, 5, 6, 7, 8, 9:
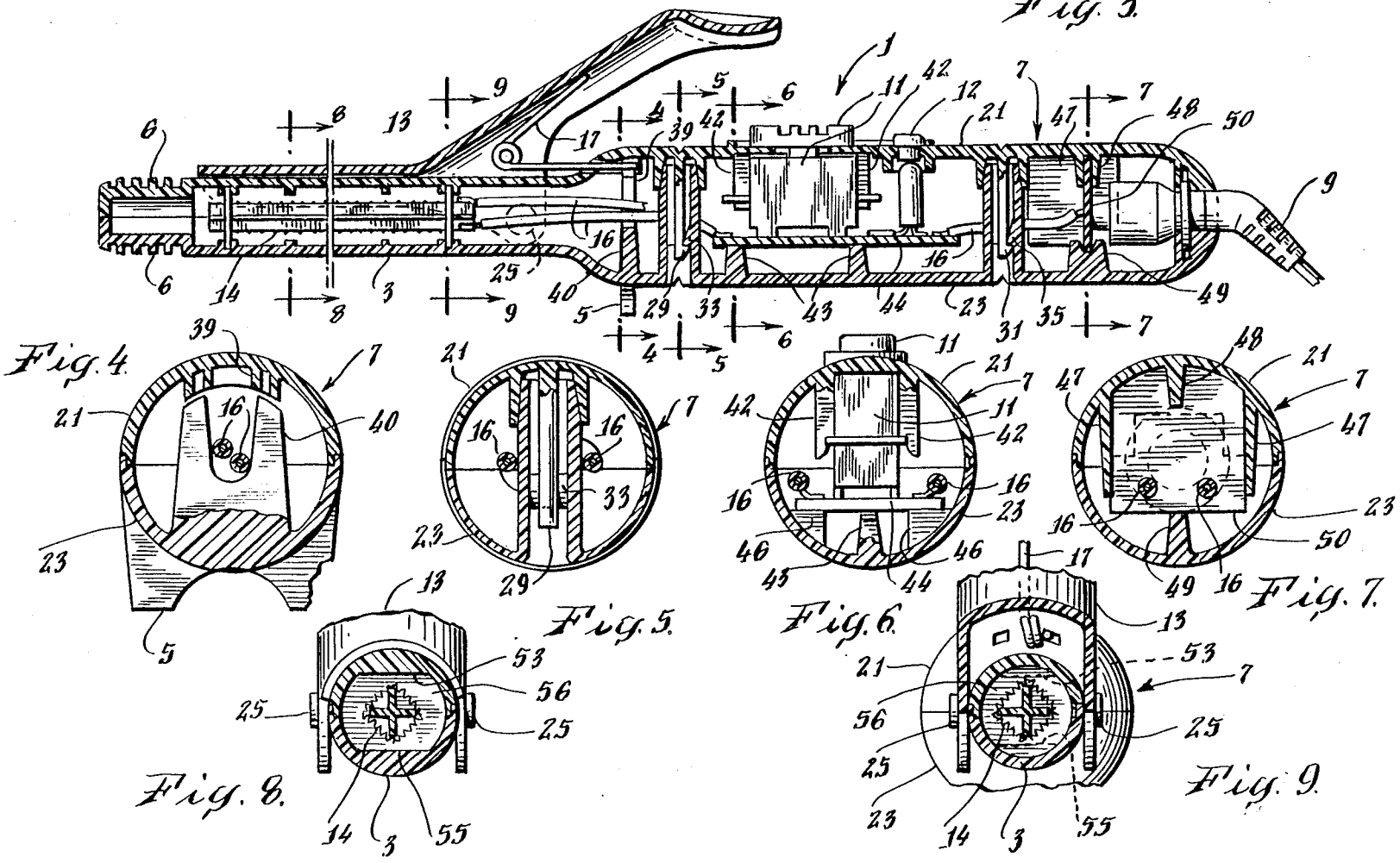
FIG. 3 is a vertical axial section of an assembled curling iron.
FIG. 4 is a vertical section taken on line 4—4 of FIG. 3.
FIG. 5 is a vertical section taken on line 5—5 of FIG. 3.
FIG. 6 is a vertical section taken on line 6—6 of FIG. 3.
FIG. 7 is a vertical section taken on line 7—7 of FIG. 3.
FIG. 8 is a vertical section taken on line 8—8 of FIG. 3.
FIG. 9 is a vertical section taken on line 9—9 of FIG. 3.

Lower section 23 includes the other one-half of the barrel and of the handle. Supporting base 5 and pivot pins 25 are integrally molded with it. Catches 33 and 35 extend inwardly for interengagement with latch members 29 and 31. These latch members and catches are positioned to complement one another and to provide a snap fit for holding the sections 21 and 23 together. The interengagement of the latches and catches is shown in FIGS. 3 and 5.

Alternatively, instead of using the catches and latch members, the two sections can be joined ultrasonically.

The internal structure of the curling iron includes and entering line cord 9, a switch 11, an indicator light 12, a heating element 14, and leads 16 running to the heating element. Element 14 may be a conventional resistance wire heater or, preferably, an infra-red heat lamp. If it is the latter, the infra-red heat rays will pass through the plastic and heat the hair directly. If it is a resistance heater, some infra-red rays will pass through the barrel, but the barrel itself is also heated.

FIGS. 4 and 6 to 9 are transverse cross-sections showing how spacers and ribs can be molded as part of the upper section 21 and of the lower section 23. These spacers and ribs serve as guides for the electrical components.

FIG. 4 shows upper spacer 39 and lower spacer 40; the latter has a central notch to receive leads 16. FIG. 6 shows upper spacers 42, lower spacers 43, and printed circuit board 44, for positioning and holding switch 11. FIG. 7 shows upper spacers 47, upper ribs 48, and lower spacers 49 which are used to hold baffle 50 near where line cord 9 enters handle 7.

FIGS. 8 and 9 each show upper ribs 53 and lower ribs 56, both used to hold positioning disks 56 in place. Disks 56 have central openings to hold heating element 14 in position.

Figure 10:
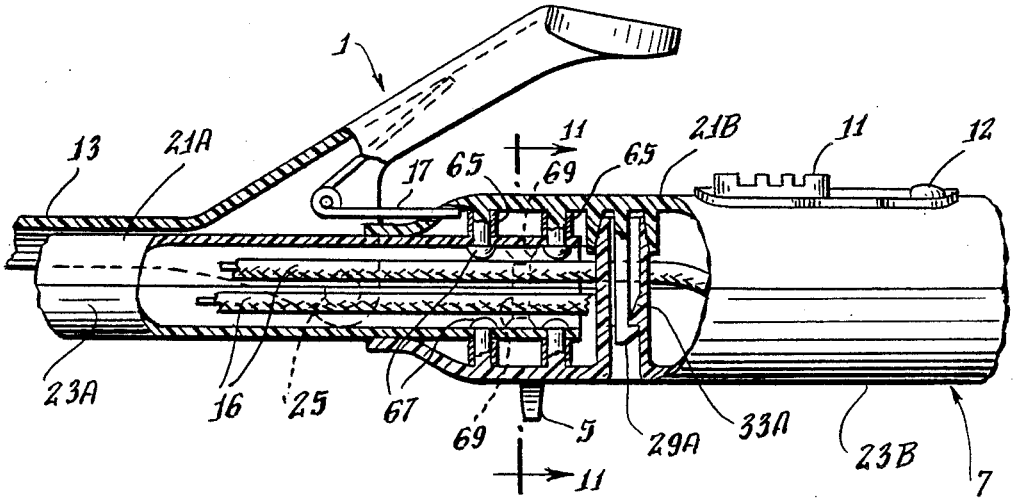
FIG. 10 is a partial side elevation, partially broken away, of a modified embodiment of my invention. In this embodiment the handle and the barrel are made of different plastic materials.
Figure 11:
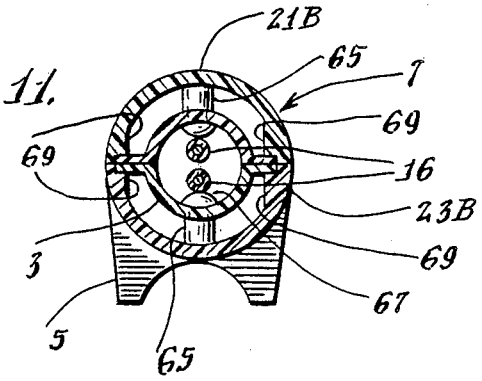
FIG. 11 is a vertical section taken on line 11—11 of FIG. 10.

There may be times when it is desireable to use a less expensive plastic for the handle portion, such as ABS, polypropylene, or General Electric's Lexan #141. In these instances the barrel portions must, of course, be separate from the handle portions. This structure is shown in the embodiment of FIGS. 10 and 11.

In this embodiment the two barrel sections are upper section 21A and lower section 23A. The upper handle section is 21B and the lower handle section is 23B. The handle sections 21B and 23B have bosses 65 molded on their inner surfaces which can be heat formed into rivet head 67 so that the upper handle section can be joined to the upper barrel section and the lower handle section can be joined to the lower barrel section. Ribs 69 (FIG. 11) formed in the inner surface of the handle serves to seat the barrel prior to heat-forming the bosses into rivet shape.

The handle sections have resilient latch members 29A and catches 33A, similar to latches 29 and 31 and catches 33 and 35, to permit snap-fit interengagement of the upper and lower sections. They work in a manner as described with reference to FIGS. 3 and 5. Preferably there will be two sets of them in the handle and a third in tip 6.

To assemble my curling iron the spacers are inserted in one of the halves 21 and 23, preferably the lower half, and the electrical components inserted. Then the two halves are snapped together. Alternatively, the latches and catches can be eliminated from the design and the two sections joined by ultrasonic welding. Assembly of the embodiment of FIGS. 10 and 11 is similar, except that it is preceded by screwing barrel section 21A to handle section 21B, and screwing barrel section 23A to handle section 23B.

I claim:

1. A moldable curling iron, said curling iron including a handle, a non-metallic barrel extending therefrom, and a spoon pivotally mounted thereon and spring-pressed towards said barrel, and an electrical heating element within said barrel, a first molded section made of high-temperature thermoplastic material which is transparent to infra-red rays, and a second section made of similar thermoplastic material, said molded sections each defining a portion of said barrel and a portion of said handle integral with one another, said sections having a complementary interfit along a common line and together defining said handle and said barrel, and means for securing said sections together.

2. A molded curling iron as set forth in claim 1 in which said common line runs generally axially of said curling iron.

3. A molded curling iron as set forth in claim 1 in which said means for securing said sections together are a plurality of resilient latch members molded on the inner surface of one of said sections and a corresponding plurality of catches molded on the inner surface of the other of said sections, said latch members and said catches being so positioned that they interengage when said sections are pressed together.

4. A moldable curling iron, said curling iron including a handle, a non-metallic barrel extending therefrom, and a spoon pivotally mounted thereon and spring-pressed towards said barrel, and an electrical heating element within said barrel, a first molded section made of thermoplastic material and a second section made of similar thermoplastic material and a molded sections each defining a portion of said barrel and a portion of said handle, said sections having a complementary interfit along a common line and together defining said handle and said barrel, said thermoplastic material section being a polyetherimide resin, and means for securing said sections together.

5. A molded curling iron as set forth in claim 4 in which said resin has a deflection temperature at about 264 p.s.i. of about 200° C.

6. A molded curling iron as set forth in claim 1 having spacers and ribs positioned within said handle and said barrel for positioning electrical components therein.

7. A curling iron for hair, said curling iron having a handle, a non-metallic barrel extending therefrom, and a spoon pivotally mounted thereon and spring-pressed towards said barrel, an electrical heating element within said barrel, and said barrel being molded of high temperature thermoplastic material.

8. A curling iron as set forth in claim 7 in which said curling iron includes two molded sections, one of said sections being a portion of said handle and a portion of said barrel and the other of said sections being the remaining portion of said handle and the remaining portion of said barrel, said sections dividing said barrel and said handle axially, said sections complementarily interfitting with one another, and means for fixedly interengaging said sections, whereby said curling iron may be easily assembled.

9. A curling iron as set forth in claim 7 in which said high temperature thermoplastic material is substantially transparent to infra-red heat rays.

10. A curling iron as set forth in claim 9 in which said heating element is an infra-red lamp.

11. A moldable curling iron, said curling iron including a handle, a non-metallic barrel extending therefrom, and a spoon pivotally mounted thereon and spring-pressed towards said barrel, and an electrical heating element within said barrel, a first molded section made of thermoplastic material and a molded section made of similar thermoplastic material, said molded sections each defining a portion of said barrel and a portion of said handle, said sections having a complementary interfit along a common line and together defining said handle and said barrel, and said sections being secured together ultrasonically.

12. A curling iron for hair, said curling iron having a handle, a non-metallic barrel extending therefrom, and a spoon pivotally mounted thereon and spring-pressed towards said barrel, an electrical heating element with said barrel, said barrel being molded of high temperature thermoplastic material, and said thermoplastic material being polyetherimide resin.

13. A curling iron for hair, said curling iron having a handle, a non-metallic barrel extending therefrom, and a spoon pivotally mounted thereon and spring-pressed towards said barrel, an electrical heating element within said barrel, two molded sections, one of said sections being a portion of said handle and a portion of said barrel and the other of said sections being the remaining portions of said handle and the remaining portion of said barrel, said sections dividing said barrel and said handle axially, said sections complementarily interfitting with one another, each said section being formed of separate handle and barrel portions which are formed of one type of said thermoplastic material for said handle and a different type of said thermoplastic material for said barrel portion, and means for fixedly securing together said handle portion and said barrel portion.

14. In a curling iron for hair having a barrel and a handle, that improvement including said barrel and said handle being formed of thermoplastic material, and said thermoplastic material being a polyetherimide resin.

15. In a curling iron for hair having a barrel and a handle, that improvement including said barrel and said handle being formed of thermoplastic material, and said thermoplastic material having a deflection temperature at about 264 p.s.i. of about 200° C.

16. A curling iron for hair, said curling iron including a barrel and a handle, two molded sections formed of thermoplastic material, one of said sections being a portion of said handle and a portion of said barrel and the other of said sections being the remaining portion of said handle and the remaining portion of said barrel, said sections complementarily interfitting with one another, and each said section being formed of separate handle and barrel portions which are formed of one type of said thermoplastic material for said handle portion and a different type of said thermoplastic material for said barrel portion.

* * * * *

UNITED STATES PATENT AND TRADEMARK OFFICE

CERTIFICATE OF CORRECTION

PATENT NO. : 4,939,340

DATED : July 3, 1990

INVENTOR(S) : Richard H. Brill

It is certified that error appears in the above—identified patent and that said Letters Patent is hereby corrected as shown below:

Change "and a" to "said" in Claim 4 at column 4, line 7

Signed and Sealed this

Twenty-fifth Day of June, 1991

*Attest:*

HARRY F. MANBECK, JR.

*Attesting Officer*

*Commissioner of Patents and Trademarks*